United States Patent [19]

Chou

[11] 3,960,074

[45] June 1, 1976

[54] LINE PRINTER HAVING HAMMER WHICH SPANS THREE PRINT POSITIONS

[75] Inventor: Albert S. Chou, Monte Sereno, Calif.

[73] Assignee: Shugart Associates, Sunnyvale, Calif.

[22] Filed: Sept. 16, 1974

[21] Appl. No.: 506,405

[52] U.S. Cl. ..... 101/93.14; 101/111

[51] Int. Cl.[2] ..... B41J 1/20

[58] Field of Search ..... 101/111, 93.03, 93.09, 101/93.14; 226/42, 120–124

[56] References Cited

UNITED STATES PATENTS

| | | | |
|---|---|---|---|
| 3,220,343 | 11/1965 | Wasserman | 101/111 X |
| 3,451,335 | 6/1969 | Cunningham | 101/111 X |
| 3,550,745 | 12/1970 | Bisone | 101/93.29 X |
| 3,611,923 | 10/1971 | Haramia | 101/93.28 |
| 3,747,521 | 7/1973 | Hamilton et al. | 101/93.14 |
| 3,752,069 | 8/1973 | Stiles | 101/93 |
| 3,805,697 | 4/1974 | Mahe | 101/111 |
| 3,823,667 | 7/1974 | Babler | 101/93 |

*Primary Examiner*—J. Reed Fisher
*Assistant Examiner*—Edward M. Coven
*Attorney, Agent, or Firm*—Boone, Schatzel & Hamrick

[57] ABSTRACT

A line printer which comprises a frame, a hammer bank secured to the frame, the hammer bank including a plurality of hammers, a ribbon that is movable past the hammers, a recirculating character belt which comprises a plurality of characters, and a band gate having an adjustable pulley arrangement for removably carrying the character belt. The band gate is pivotally mounted to the frame in such a manner that the distance between the hammers and the characters is adjustable to accommodate paper of varying thicknesses. A phasing circuit controls the firing of the hammers. An adjustable paper feed mechanism controls the positioning of continuous paper form as it passes through the print line, and a stepping motor controls the paper feed mechanism to provie 6 or 8 print lines per inch in such a manner as to reduce the time required to advance the paper to the next print line. Each hammer face spans three print positions, and the character pitch is greater than the width of a hammer face such that each hammer is able to strike a single selected character in three successive print positions.

13 Claims, 12 Drawing Figures

LINE PRINTER HAVING HAMMER WHICH SPANS THREE PRINT POSITIONS

BACKGROUND OF THE INVENTION

1. Field of the Invention

This invention relates generally to a back printing line printer, and more particularly to a line printer that includes a bank of print hammers, the face of each hammer spanning three print positions, and a recirculating character belt, the pitch between adjacent characters being greater than the width of a hammer face such that each hammer is able to strike a single selected character in three successive print positions.

2. Description of the Prior Art

In many printers in the prior art, a chain of uniformly spaced print characters is moved at constant speed in a continuous path, a portion of the path lying on a print line extending transversely of a paper-receiving web, which in turn is fed intermittently, line by line, into registry with the print line by a feed mechanism under electronic control. A plurality of electromagnetic hammers located respectively on print columns in the print line, are operated selectively by controlled electronic firing circuits to impress the web against a selected print character on the print line as that print character moves into registry with the print column on which the selected hammer is located. Accordingly, in these printers, each hammer spans a single print position such that 132 hammers are required to cover a 132 character print line.

In order to decrease the manufacturing and maintenance costs of a printer, attempts have been made to reduce the number of hammers included within the hammer bank and their respective electronic driving circuits. In one instance the hammers are separated by two print positions and the paper is shuttled laterally over the print positions. However, the complexity of shuttling the paper precludes this attempt from viability in the market place. In another type of printer, one-half of the number of hammers is utilized, and these hammers are mechanically shifted such that each hammer prints odd and even characters. Alternatively, one-fourth the number of hammers is used and shifted mechanically such that each hammer is only able to print every fourth character. Still another approach is to utilize one-half the number of hammers and to separate the hammers such that the pitch between adjacent hammers spans two print positions. In conjunction with this hammer configuration, a character belt with a pitch of two print positions is used. Thus, at any one time only one character is in front of each hammer and hence, two passes of the character set is required to print a full line. Also, in each of these configurations, because of the movement required of either the hammer or the paper, or because of high character velocity, poor print quality, higher product cost and low machine reliability results.

SUMMARY OF THE INVENTION

It is therefore an object of the present invention to provide a low cost line printer that is relatively simple to manufacture and which is reliable in operation.

Another object of the present invention is to provide a line printer in which each print hammer covers three print positions so as to reduce the number of hammers and hammer driving circuits required in the hammer bank.

Still another object of the present invention is to provide a printer which uses a removable recirculating character belt and a stored energy print hammer in a back printing mode to produce a high quality printing on single or multipart paper forms.

Still another object of the present invention is to provide a printer which may be attached to small business and scientific data processing systems, and which may also be used in data communication systems.

Briefly, the present invention is directed toward a back printing line printer which comprises a frame, a hammer bank secured to the frame, the hammer bank including a plurality of hammers, a ribbon that is movable past the hammers, a recirculating character belt which comprises a plurality of characters, and a band gate for removably carrying the character belt. The band gate is pivotally-mounted to the frame in such a manner that the distance between the hammers and the characters is adjustable to accommodate paper of varying thicknesses and to facilitate operator insertion of forms. A pair of pulleys are arranged to carry the belt in a manner which simplifies its removal. A phasing circuit including a phase-locked oscillator (PLO) controls the firing of the hammers to compensate for the variation and distance between the hammers and the characters. An adjustable paper feed mechanism controls the positioning of the paper form as it passes the print line and a counting circuit and a stepping motor are employed to selectively provide either 6 or 8 lines of printing per inch while controlling the feed mechanism in such a manner as to reduce the time required to advance the paper to the next print line. Each hammer face spans three print positions and the character pitch is greater than the width of a hammer face such that each hammer is able to strike a single selected character in three successive print positions.

An advantage of the present invention is that it is relatively inexpensive to manufacture since each hammer spans three print positions. In addition, since the shadow or background associated with the striking of a print hammer on the copies of a paper form is inversely proportional to an exponential function of the area of the hammer face, less shadow is produced by the multiple strikings of the same hammer than by a single striking of a hammer spanning a single character.

Another advantage of the present invention is that the distance between the hammers and the character belt is adjustable so as to accommodate varying thicknesses of paper whereas the firing time of the hammers is controlled to compensate for varying distances between the hammers and the character band.

Still another advantage of the present invention is that it includes a stepping motor that is arranged to decrease the time required to advance paper to a successive print line.

Other objects and advantages will be apparent to those skilled in the art after having read the detailed disclosure which makes reference to the several figures of the drawings.

IN THE DRAWING

DETAILED DESCRIPTION OF THE PREFERRED EMBODIMENT

Figure 1:
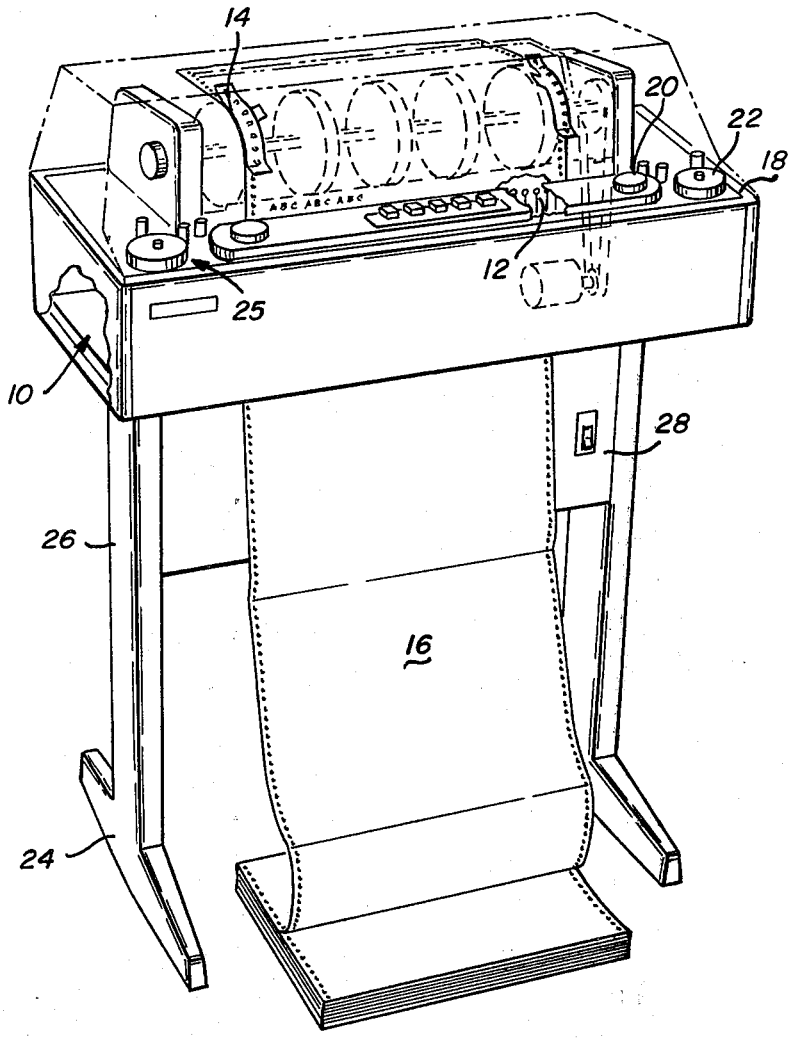
FIG. 1 is a perspective view of the line printer in accordance with the present invention.

Referring now to FIG. 1 of the drawings, the line printer of the present invention is illustrated. The printer includes a frame 10, a hammer bank 12, a paper feed mechanism, generally designated by the numeral 14, for driving continuous paper form 16 over the faces of the hammers in the hammer bank 12, a character band gate 18 which is pivotally secured to the frame 10, a recirculating character belt, or band 20 removably mounted by a pulley arrangement (see FIG. 4) on the gate 18, and a ribbon assembly 22 which is mounted on the gate 18.

The frame 10 includes a base 24 on which a pair of upright members or columns 26 are supported. An enclosure 28 extends across the width of the frame and houses the electronic logic and power supplies (not shown) directly beneath the printer mechanism. Covers enclose the printer mechanism. Preferably, the covers and the housing are anechoically treated so as to prevent the noise caused by the impact between the hammers and the characters from escaping. It will be appreciated therefore that the frame structure illustrated in the drawings, though preferable, may be modified significantly to satisfy the needs of a particular installation or, if desired, to modify the exterior design features of the printer.

Figure 2:
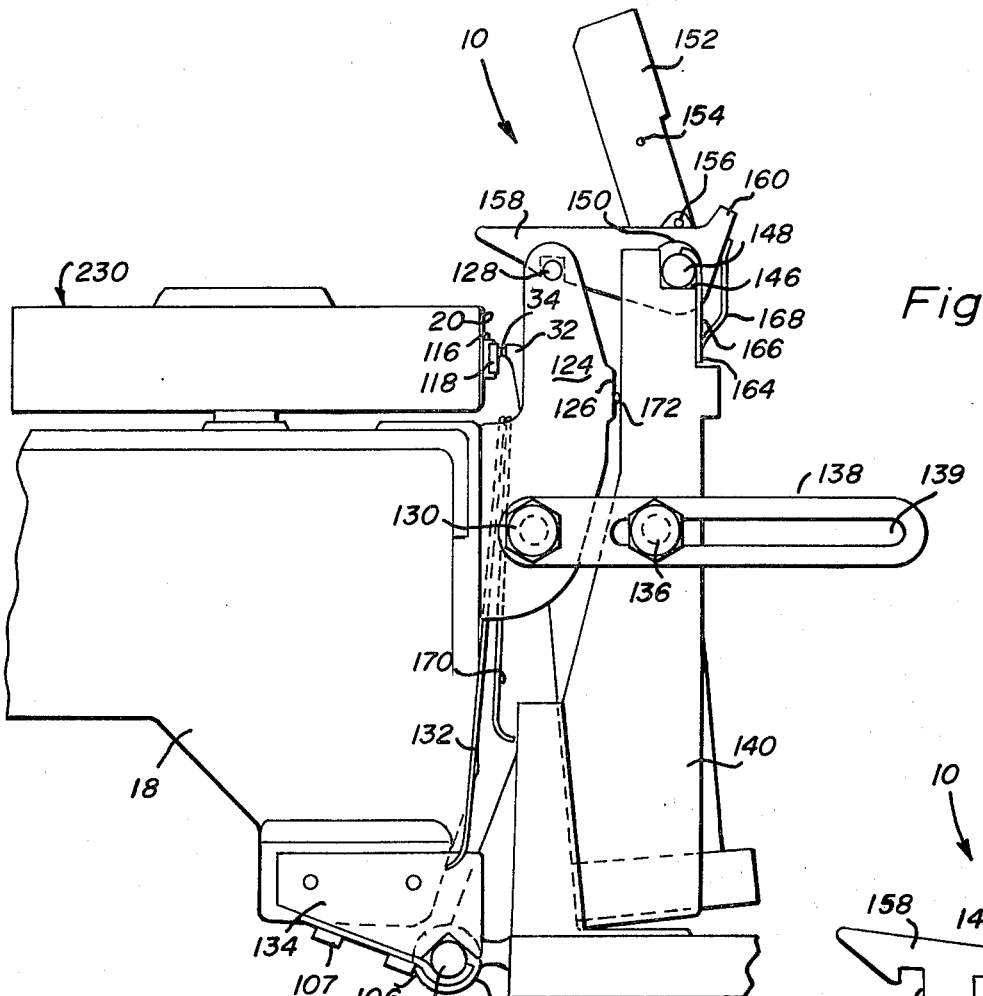
FIG. 2 is a side elevational view of a portion of the line printer of the present invention illustrating the attachment of the band gate to the frame.
Figure 3:
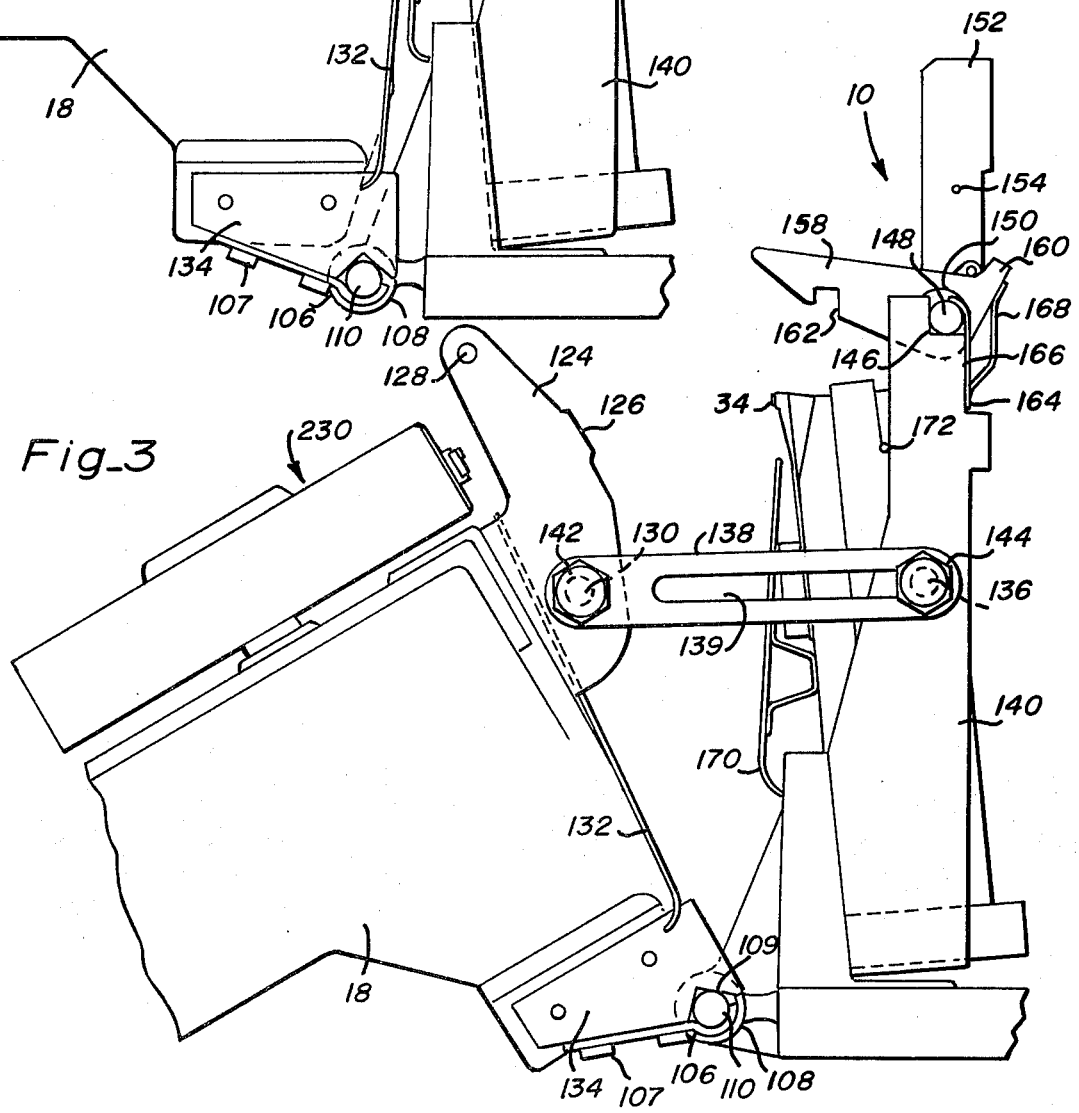
FIG. 3 is a side elevational view of the portion of the line printer similar to that of FIG. 2 illustrating the band gate pivoted away from the frame.
Figure 8:
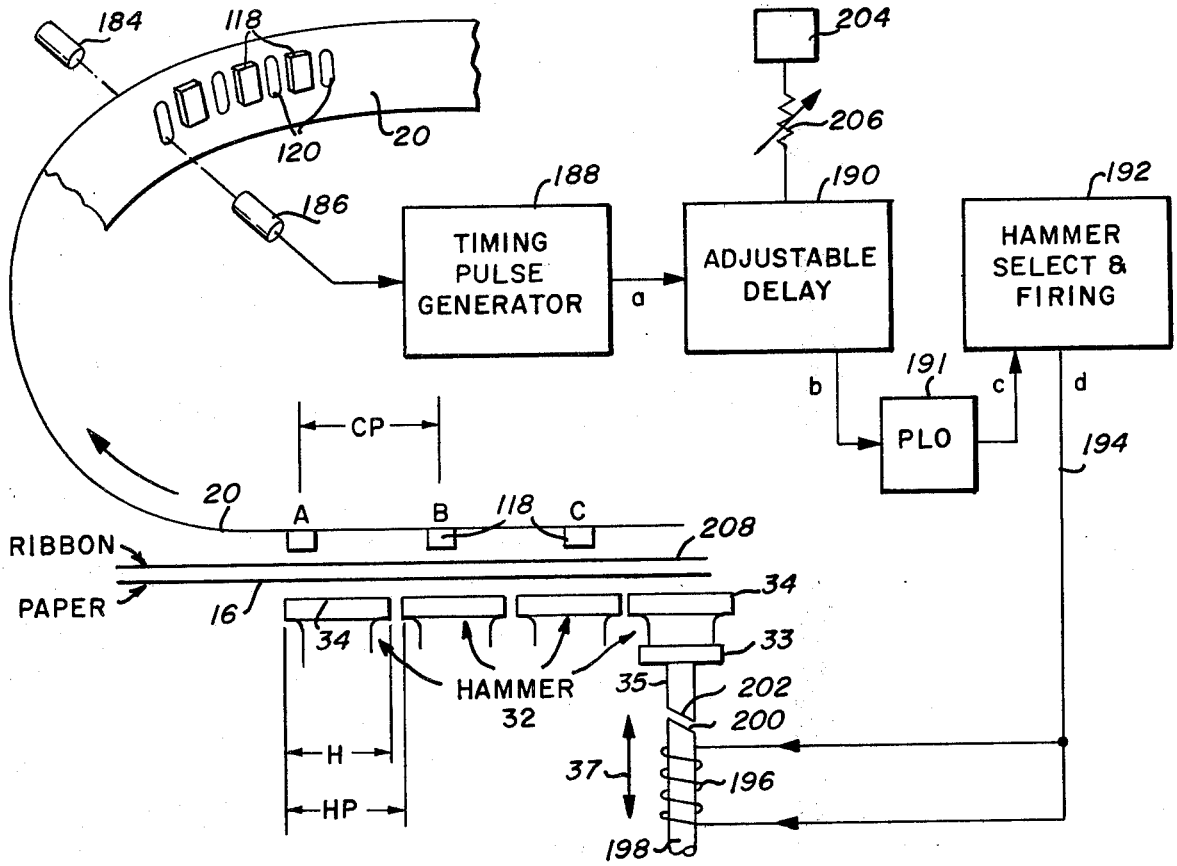
FIG. 8 is a schematic diagram of a portion of the hammer bank, the character belt and the paper illustrating the relationship between the hammer pitch and the character pitch, and the hammer firing circuit which enables the hammer to strike a single selected character in three successive print positions.
Figure 8:
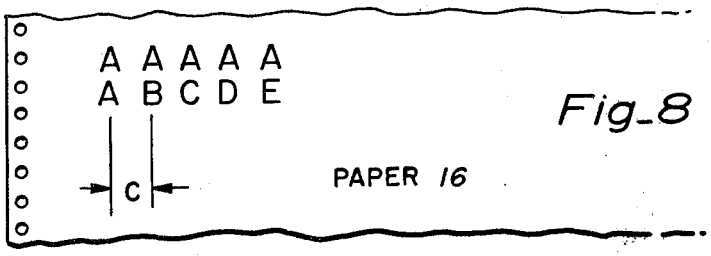

The hammer bank 12, shown partially in FIGS. 2, 3 and 8, is modular in construction and comprises 44 hammers which cover a print line that is 132 characters long. The particular details of construction of the hammers have been omitted from this specification since these are the same as described in copending U.S. Pat. application, Ser. No. 464,851, entitled "Print Hammer Apparatus with Angularly Disposed Mating Hammer and Pole Faces to Prevent Contact Bounce," invented by Warren L. Dalziel, and that application is incorporated by reference to this specification for any details not disclosed herein. As disclosed in the Dalziel application, the print hammer apparatus (see FIG. 8) includes a resilient member, or spring 33, having a fixed end and a movable end, the movable end being movable between a cocked position and a striking position, a hammer 32 affixed to the movable end and carried thereby over an arcuate path between the cocked position and the striking position, the hammer including an impact head, or face, 34, at one end and a flag member 35 at the other end. The width of the hammer face 34 is designated by the letter H and the pitch between adjacent hammers is designated by the letters HP. The flag member 35 is formed from a magnetic material and has a flag face 202 with a surface which is at all points angularly disposed at an angle other than normal to the path. The path is designated as being in the direction of the arrows 37 in FIG. 8. A stator pole piece 198 has a pole face 200 which matingly corresponds to the flag face 202. A magnetic side pole (not shown) is disposed laterally of the path 37, and a permanent magnet is coupled to the pole piece 198 and to the side pole and is operative to develop a magnetic force for causing the hammer 32 to move against the influence of the resilient member 33 and into the cocked position with the flag face 202 engaging the pole face 200. A coil 196 is disposed on the pole piece 198 for momentarily developing a magnetic flux in opposition to the flux developed by the permanent magnet, thereby reducing the magnetic force and allowing the hammer to move along the path 37 into the striking position under the influence of the resilient member 33. The resilient member thereafter returns the hammer along the path to the cocked position whereby the flag face impacts the pole face and whereby the interaction of the angularly engaging faces and the magnetic relationships between the pole piece, the flag member and the side pole cause the hammer to experience substantially no contact bounce. With this configuration, hammer recycle times of 1.2 milliseconds are consistently and reliably achieved. This rapid cycle capability permits one hammer to span three character columns, as will be subsequently described, thus reducing the number of hammers and drive circuits required in a full 132 column printer.

Figure 10:
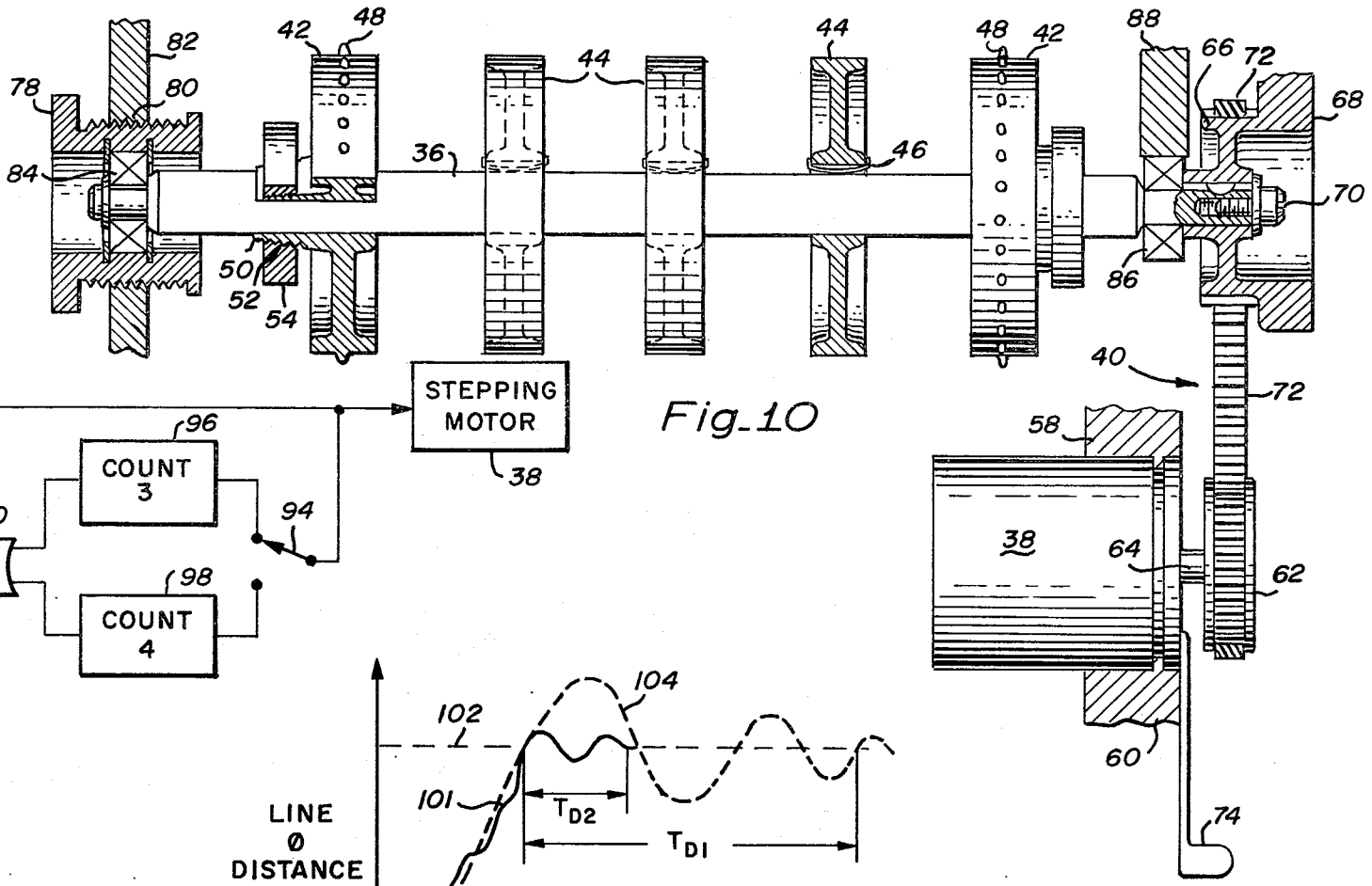
FIG. 10 is a cross-sectional view of the paper feed mechanism of the present invention.

The paper feed mechanism 14 is illustrated schematically in FIG. 1 and in more detail in FIG. 10. As shown therein, the mechanism is secured to the frame 10. The mechanism comprises a square shaft 36, a stepping motor 38, coupling means, generally designated by the numeral 40, for coupling the stepping motor to the shaft, and a pair of pin feed wheels 42 which are adjustably disposed on the shaft 36. Three support wheels 44 are disposed between the feed wheels 42 for supporting the paper across its width. The support wheels 44 are adjustably secured along the shaft 36 by means of a spring clip 46. Preferably, the support wheels 44 are fabricated from a plastic material. It should be recognized that the inner periphery of the support wheels is rectangular in shape to receive the square shaft 36. The pin feed wheels 42 include 22 outwardly protruding pins 48 around their outer circumference which are spaced to mate with adjacent perforations near the outer edges of the paper so as to drive the paper upwardly upon the rotation of the shaft 36. Extending axially outwardly from one side of the inner periphery of the pin wheels is a threaded portion 50 which comprises a stepped thread that is downwardly tapered as at 52. A locking nut 54, which includes a similarly-shaped stepped inner periphery locks the pin feed wheel 42 to the shaft in its desired position. By this arrangement, the pin feed wheels may be selectively positioned to accommodate various form widths and positions of the paper.

The stepping motor 38 having an output shaft 64 is mounted to a portion of the frame 60. A pulley 62 is secured to its output shaft 64. A pulley 66 that is integrally formed with a hand wheel 68 is disposed over the shaft 36 and locked to the shaft 64 by a screw 70. A timing belt 72 couples the pulley 62 to the pulley 66 for driving the shaft 36. Alternatively, a spline cone may be used to engage the pulley 66 for driving the shaft. In order to adjust the angular position of the pin wheel shaft 36, and consequently the vertical print registration, a lever 74 is secured to the stepping motor 38. Movement of the lever 74 causes the stepping motor 38 to rotate within its mounts 60, thereby changing the angular position of the motor and dynamically adjusting the vertical print registration.

An adjusting mechanism is provided for adjusting the horizontal position of the shaft 36. This adjusting mechanism includes a vernier knob 78 which is threaded as at 80 so as to be received through a corresponding threaded aperture through the support casting 82. Disposed within the knob and around the shaft 36 is a bearing assembly 84 which moves horizontally with the knob, thereby causing a small relative horizontal movement of the shaft. A bearing assembly 86 disposed at the other end of the shaft, which has a sliding fit relationship with its associated casting 88, facilitates movement of the shaft. Accordingly, this mechanism provides an adjustable vernier movement of the shaft, thereby providing dynamic transverse adjustment of printing.

Although not shown, a column aligner guide and a line pointer provide a reference for setting the registration of the paper form initially by means of the vernier knob 78 and the lever 74. A paper tensioner (not shown) and an out-of-paper sensor (not shown), which is located below the print line station are used in combination to indicate that the machine is ready for operation when paper is received by the feed mechanism. In the preferred embodiment, the pinwheels are able to selectively accommodate paper widths from 4 to 14 7/8 inches.

Figure 11:
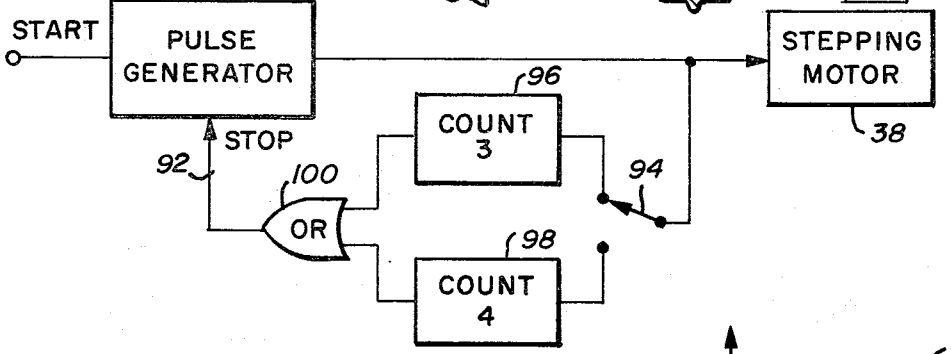
FIG. 11 is a schematic diagram, shown in block form, of the pulse generating and counting circuit which is connected to the stepping motor of the paper feed mechanism of FIG. 10.

A counting circuit, schematically illustrated in FIG. 11, is employed in combination with the stepping motor 38 to selectively provide either six or eight lines of printing per inch. As shown, the circuit comprises a pulse generator 90 which is responsive to a start pulse applied at its input and which is operative to provide a pulse train for driving the stepping motor 38. A feedback loop is connected between the output of the pulse generator and a control terminal, indicated by the numeral 92, which is operative to stop the generation of pulses from the pulse generator 90. The feedback loop includes a switch 94, counters 96 and 98, and an OR gate 100. The switch 94 is selectively connected so as to conduct the pulses from generator 90 to either of the counters 96 or 98. An OR gate 100 is connected between the output of the counters 96 and 98 and the control terminal 92. Counter 96 is designated as the Count 3 counter and is responsive to three pulses before sending a stop pulse to the pulse generator. Similarly, counter 98 is responsive to four pulses before applying a stop pulse to the generator.

Figure 12:
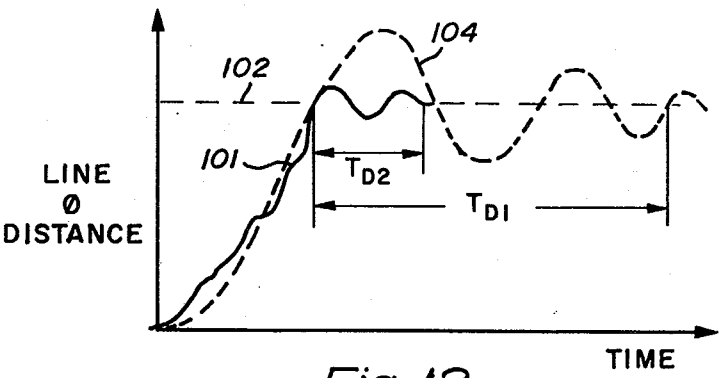
FIG. 12 is a graph depicting the distance traveled in advancing the paper one line versus time. The dashed lines indicate the graph obtained with a prior art paper feed mechanism.

When four pulses are applied to the motor 38, the shaft 36 is advanced through four increments, thereby advancing the paper one line. With reference to FIG. 12, a graph of the distance traveled by the paper feed mechanism is illustrated as a function of time. The path traveled by the mechanism is illustrated in solid by the numeral 101 and is shown to include four distinct steps before it reaches the one line advance position, illustrated by the numeral 102. In order to observe the advantages of this application of a stepping motor, a curve, designated by the numeral 104, is illustrated by the dashed lines in FIG. 12. This curve 104 corresponds to the distance traveled by the paper feed mechanism if a single pulse is applied to advance the paper feed to the next line. As shown by the dashed lines, the single pulse technique includes a substantial overshoot and consequent ringing, before stability is achieved. As illustrated in FIG. 12, the settling time is indicated as $T_{D1}$. It has been found that the peak-to-peak distance between the overshoot and the undershoot in the single step per line case is on the order of 50% of the distance of the step when the stepping motor has a one-to-one ratio. Because of the substantially large amplitudes of the oscillation, the settling time required is between 10 and 15 milliseconds. In contrast, the multistepped arrangement of curve 101 exhibits an oscillation amplitude that is only about one-quarter of that of curve 104 and requires a shortened settling time of $T_{D2}$. In addition, a smaller stepping motor may be used because of the lower effective load inertia.

In the preferred embodiment, the stepping motor 38 is characterized as producing 200 steps per revolution, whereby each step may be translated into a corresponding angle of 1.8°. The single line advance and settling time requires 25 milliseconds. The line spacing is 0.167 inches when the six printing lines per inch are chosen and 0.125 inches when the eight lines per inch mode is chosen. When the spacing between the lines exceeds one line, the paper is advanced to the next print line in a slew mode at 10 inches per second. The switch 94, which enables the selection of either 6 or 8 lines per inch, is preferably located within the covers of the printer so as to be accessible to the operator.

Figure 4:
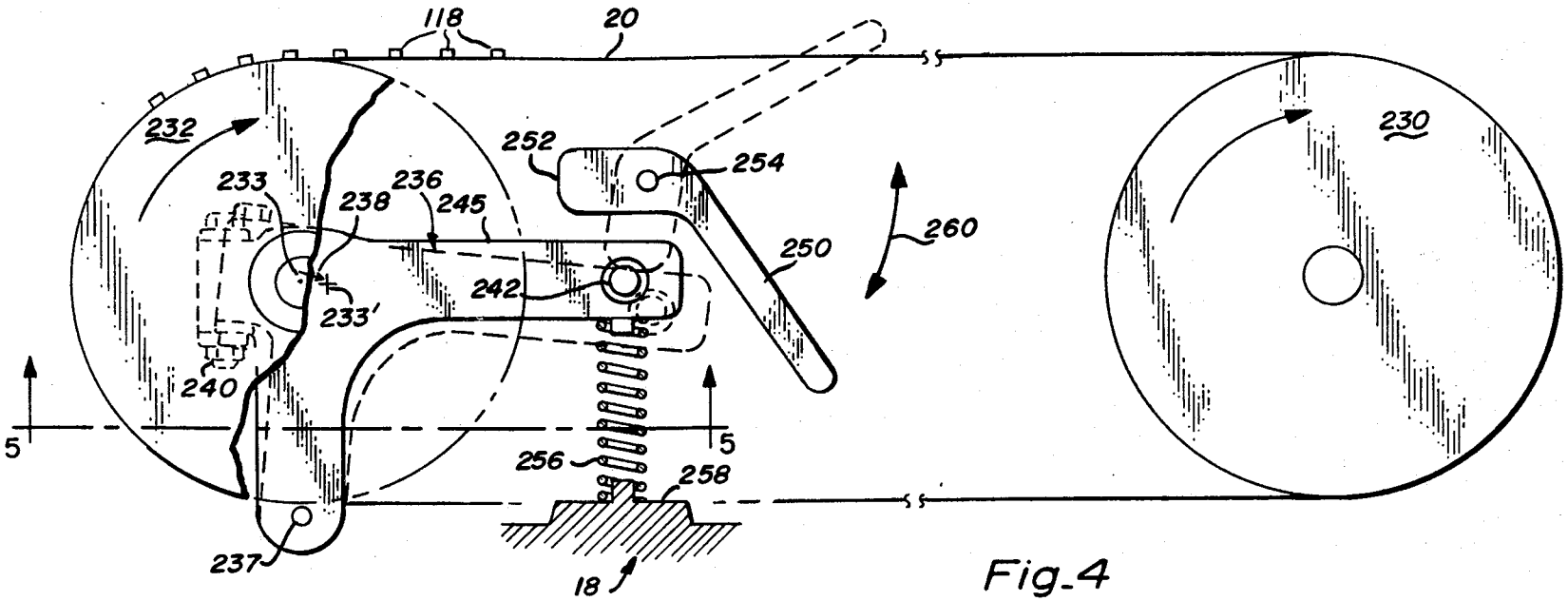
FIG. 4 is a plan view of the pulley arrangement which facilitates removal of the character belt from the printer.
Figure 5:
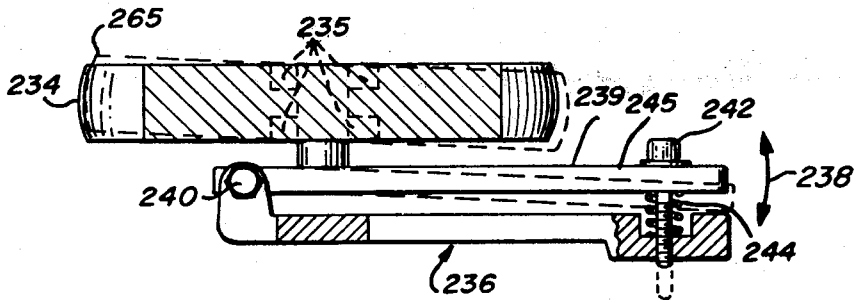
FIG. 5 is a side elevational view taken through the lines 5—5 of FIG. 4 illustrating a skew adjusting feature of the pulley arrangement.

The band gate 18 of the printer is illustrated in FIGS. 2 and 3 in a closed printing position (FIG. 2) and an open paper-loading position (FIG. 3) relative to the frame 10. The upper surface of the band gate is substantially planar. A pair of pulleys 230 and 232 extend through the top surface (as shown) in (FIGS. 4 and 5). The character belt 20 is removably disposed over the pulleys 230 and 232 so as to be easily replaceable by the operator as will be subsequently described. One of the band drive pulleys 232 is movable, allowing the band 20 to be replaceable by the operator. The character belt 20 includes a thin, flexible metal belt that is formed into an endless band. A plurality of slug-mounting elements 116 are affixed to the outer surface of the belt at equally spaced-apart locations (see FIG. 8). A replaceable character slug 118 is carried by each of the slugmounting elements 116. Each of the character slugs 118 has a front face on which an alphanumeric or graphic character is provided. The pitch of the printed characters is designated by the letter C, and the pitch between adjacent character slugs by the letters CP.

Between adjacent character slugs, apertures 120 are removed from the belt for relieving stresses at the attachment areas which are set up in the metal belt as it is bent around the pulleys 230 and 232, and as will be subsequently described, for developing clocking pulses for controlling the timing between the character position and print hammer firing. The particular details of construction of the character belt 20 have been omitted from this specification since these are the same as described in copending U.S. Pat. application, Ser. No. 464,472, entitled "Character Belt Apparatus with Replaceable Slugs for Line Printer," invented by Harold C. Medley. That application is incorporated by reference to this specification for any details not disclosed herein.

Referring now to FIGS. 4 and 5, the pulley arrangement for mounting the character belt 20 is illustrated. The pulley arrangement includes a drive pulley 230 and a driven pulley 232 having a center point 233. The driven pulley 232 has a crowned periphery 234 and is rotatably carried on bearings 235 which extend from a yoke assembly 236. The yoke assembly 236 is secured to the band gate (not shown) by a pivot pin 237 which allows the yoke assembly 236 to pivot in the direction of the arrow 238. The yoke assembly 236 includes an upper skew-adjusting arm 239 that is pivotally secured to one end of the yoke assembly with a skew-adjusting pivot pin 240. An adjustment scew 242 fastens the arm 239 to the yoke assembly 236 in a manner so as to control the skew of the pulley 232. A take-up spring 244 biases the leg portions 245 of the yoke assembly 236 and the arm 239 away from one another. A handle 250 having a camming surface 252 is pivotally secured to the band gate by handle pivot pin 254. In its normal position, shown in solid lines, the camming surface 252 is slightly separated from the leg portion 245 of the yoke. A spring 256 extending between a surface 258 of the band gate and the leg portion 245 serves to bias the yoke in the normal position, and to provide the proper tension on the character belt 20.

In operation, as the handle 250 is rotated in the direction of the arrow 260, the camming surface 252 engages the leg portion 245 of the yoke 236 and causes the yoke to pivot around pin 237. As the yoke pivots, its center point 233 moves in the direction of the arrow 238 to the new location 233'. In this relaxed position, illustrated by the dashed lines of FIG. 4, the driven pulley 232 is moved toward the drive pulley 230 which effectively decreases the tension in the belt 20. Consequently, an operator may readily remove the loosened belt. To eliminate skew between the pulleys, as illustrated by the dashed lines 265 in FIG. 5, the adjustment screw 242 is provided. As seen, movement of the screw 242 causes the arm 239 to pivot about pin 240 relative to the yoke 236, thereby moving the crowned periphery of the pulley until the pulleys 230 and 232 are aligned with one another.

In accordance with a feature of the present invention, the pitch HP between adjacent hammers is equal to three times the character column pitch C. In addition, the character pitch CP is greater than three times the column pitch C. Obviously, the width H of a hammer face is less than the pitch HP between the hammers. Because of this relationship, only one character is in front of any one hammer at any instant in time. Since the hammer has a very high recycle rate, a single hammer may be fired in three successive print positions. For instance, in order to print three successive capital letters A, as illustrated in a portion of FIG. 8, the same hammer in the bank is caused to strike the identical character, A, three successive times, as the character slug moves past the hammer face.

The ribbon assembly 22 which is mounted on the top surface of the band gate includes a reversing drive that is used to feed a ribbon between the reels 25. The takeup reel is constantly driven by a torque motor in the rewind direction to hold tension on the ribbon. The drive reel is driven either forward or reverse through a gear motor which is pulsed on each line advance to increment the ribbon. Reversing occurs when the ribbon reaches the end attachment of the take-up reel. A sensor (not shown) detects an eyelet in the ribbon and actuates the reversing circuitry. Preferably, the printer ribbon is ½ inches wide and about forty yards long and is angled across the print line station to maximize usage of the ribbon width. Access to the ribbon is obtained by swinging out the band gate 20, as will be subsequently described.

Protruding rearwardly from the underside of the band gate 18 near its sides are a pair of arms 106. The arms are secured by bolts 107. Plates 134 which are notched as at 109 are secured to the sides of the band gate near the arms 106, with the respective top surfaces of the plates serving to clamp paper guides 132. Also affixed to the sides of the band gate 18 are a pair of rearwardly protruding mounts 124, which are formed so as to define raised registration surfaces 126. A latch pin 128 and a bolt 130 protrude outwardly from the outer sides of the respective mounts 124. A stop 138, which is slotted as at 139, is secured to the band gate by the bolt 130.

Extending forwardly of the frame 10 at either side thereof are ring-shaped members 108 at positions just inside of and in alignment with the arms 106. Pivot pins 110 are inserted through the openings in the members 108 and the openings created between the arms 106 and the notch 109 so as to pivotally support the band gate on the frame. The hammer bank assembly 12 is secured to the frame 10 by screws (not shown) between side posts 140 in a manner such that the respective hammer faces 34 are directed toward the character band and in alignment with the faces of the character slugs 118. Extending outwardly from the side post 140 within the slot 139 in the stop 138 is a bolt 136. Nuts 142 and 144 are secured to the respective bolts 130 and 136. Accordingly, the stop 138 serves to limit the angle of rotation of the band gate when it is moved to the open position to about 30 degrees. A plunger 172 is secured to the front face of the post 140 in alignment with the raised registration surface 126 and serves to urge the mounts 124 outward when the band gate is in the closed position. A handle assembly 152 comprises a detent 154, a pawl 156 and a shaft 148. A latch plate 158 is formed so as to include a notch as at 162, a tongue 160, and an aperture. The shaft 148 is disposed through the aperture of the plate 158 and into engagement with the surfaces defining the notch 146. The surfaces defining the notch 162 are machined to provide a precise registration with the pin 128 that protrudes from the mount 124 when the band gate is in the closed position. A bifurcated spring 164 is disposed against the rear surface of the post 140. One leg 166 of the spring 164 extends over the notch 146 and serves to hold the shaft 148 rotatably therein. The other leg 168 extends rearwardly of the post 140 in an abutting relationship with the latch 160 and serves to bias the plate 158 toward its closed or latching position.

A paper guide 170 is secured to the front face of the frame 10. The paper guide 170 is positioned so as to coact with the paper guide 132 and serves to guide the paper 16 between the hammer face 34 and the character slug 118.

Figure 6:
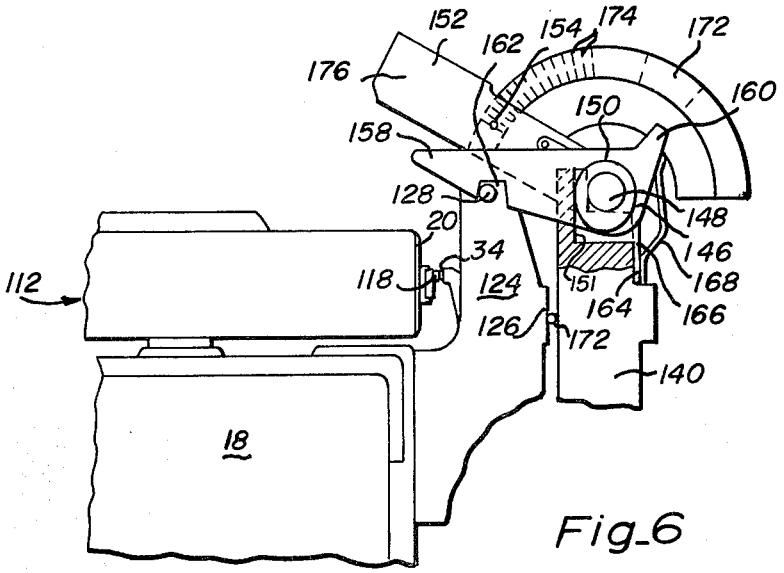
FIG. 6 is a side elevational view of a portion of the line printer illustrating the paper thickness adjustment mechanism in accordance with the present invention.
Figure 7:
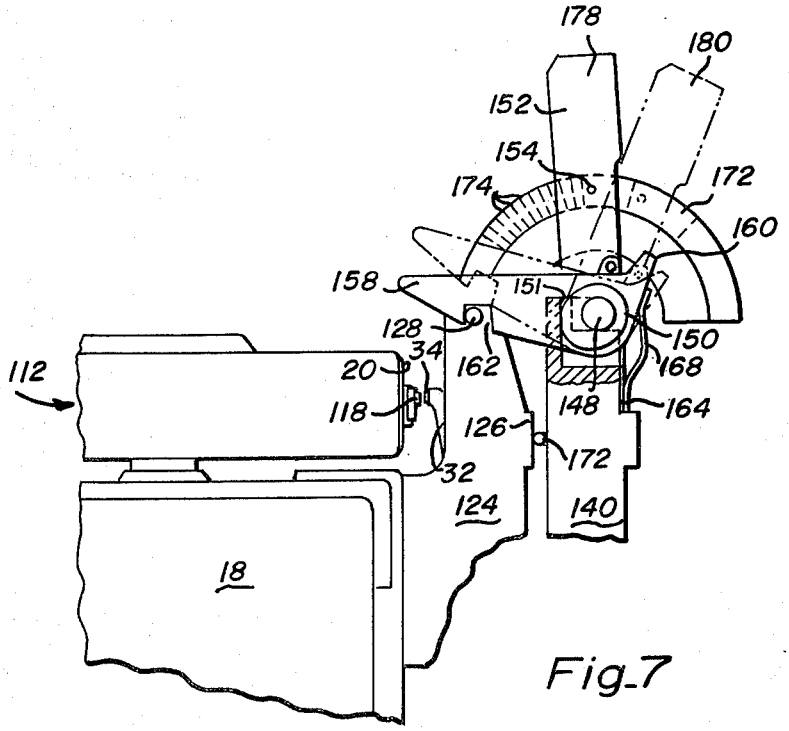
FIG. 7 is a side elevational view of a portion of the line printer similar to that of FIG. 6 illustrating the handle of the paper thickness adjustment mechanism in several positions.

Referring now to FIGS. 6 and 7 of the drawings, the paper thickness compensation mechanism is illustrated. The mechanism comprises many of the same elements shown in FIGS. 2 and 3, and identical numbers are used to identify the same elements. In addition, the compensation mechanism includes a detent block 172 comprising a plurality of detents 174 which are arranged annularly around the block 172 such that each detent 174 may be engaged by the detent 154 protruding from the handle 152. With reference to FIG. 6, the handle is illustrated in a lowered position 176 such that the distance between the hammer face 34 and the front surface of the character slug 118 defines a minimum gap. The antibacklash plunger 172 forces the mount 124, and consequently, the band gate 18 outward such that the latch pin 128 is in registration with the forward-most mechanical surface of the notch 162 when the band gate is in the closed or printing position, thus assuring that the minimum spacing is maintained.

In order to load paper into the printer, the band gate is pivoted about the pin 110 by raising the handle 152 such that the pawl 156 is forced against the latch 160. Continued movement of the handle causes the notch 162 to become disengaged from the latch pin 128. Consequently, the plate 158 is raised, and the band gate is allowed to swing open. The slot 139 in stop 138 limits rotation of the band gate to an angle of about 30 degrees. With the band gate pivoted open, clear access to the paper feed mechanism is provided. Referring also to FIG. 1, paper is loaded from the front of the printer. As illustrated, a fanned, folded stack of paper is placed on the floor and fed upwardly between the band gate and the frame, through the guides 132 and 170, and over the top of the machine. Thereafter, the band gate is pivoted back into its closed position with the latch pin 128 firmly secured within the notch 162.

When it is desired to utilize a thicker paper, the gap distance is increased by rotating the handle 152 upwardly such that the detent 154 is caused to successively engage the several detents 174. The upward rotation of handle 152 causes the eccentric 150 to cam against the surface 151 and move the shaft 148, and thus the plate 158 therefore increasing the distance between the type slug 118 and the hammer face 34. The handle is shown in its raised position, as illustrated by numeral 178. In this position, a maximum gap distance occurs between the hammer face and the front surface of the character slug and determines the maximum thickness of the paper that can be received by the printer. If the handle is rotated past the position 178, it moves into the previously described latch release position, designated by the numeral 180, and shown by dashed lines, in which the notch 162 is rotated out of engagement with the latch pin 128.

Figure 9:
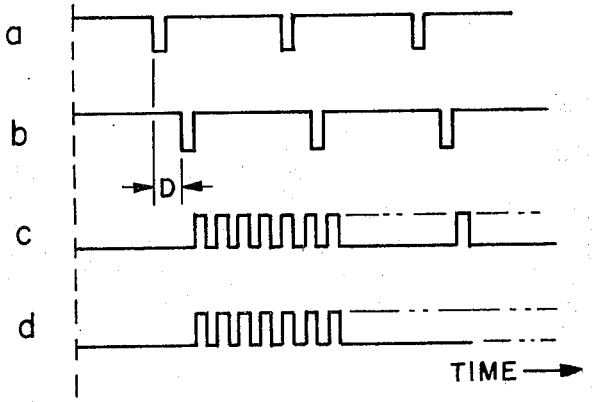
FIG. 9 is a timing diagram for the hammer firing circuit illustrated in FIG. 8.

Because of the several paper thicknesses that are accommodated by the line printer of this invention, a control circuit is provided which adjusts the hammer firing in accordance with the particular paper thickness. The control circuit is illustrated schematically in FIG. 8. As shown therein, a light source 184, which is preferably a light-emitting diode, is positioned on one side of the character belt 20 in alignment with the apertures 120. On the other side of the belt, a light-receiving means 186, which is preferably a photo transistor, is positioned so as to receive the light emitted by the source 184 whenever the aperture passes therebetween. The output of the photo transistor 186 is coupled to a timing pulse generator 188 which develops a signal illustrated by wave form a in FIG. 9. The timing pulse is applied to an adjustable delay circuit 190 which delays the pulse by time interval D to provide a delayed pulse signal represented by the wave form b of FIG. 9. This delayed pulse signal is applied to a phase lock oscillator (PLO) 191 which converts the delayed pulse into six equally-spaced pulses as shown by the wave form of FIG. 9*c*. This train of pulses is applied to a hammer select and firing circuit 192 which develops a series of time-spaced, hammer-driving pulses, represented by wave form *d* of FIG. 9. When it is desired to fire a particular hammer, a hammer-driving pulse of the proper phase is selectively applied on conductor 194 to the electromagnetic coil 196 that is arranged over the stator pole 198 of the selected hammer 32. It should be recognized that other conductors interconnect the output of the hammer select and firing circuit 192 to coils positioned over the other hammers associated with the hammer bank 12. In order to provide the adjustable delay D, an adjustment circuit is associated with the adjustable delay circuit 190. This adjustment circuit includes a knob 204 that is positioned on the top surface of the operator panel (not shown) which is arranged to control a variable resistor 206 which in turn controls the delay D in a manner well known in the art. Accordingly, as described in the Dalziel application, upon energization of the coil 196 a bucking magnetic flux is developed in opposition to the flux developed through the stator pole by a permanent magnet (not shown). The bucking flux reduces the magnetic force and allows the hammer to move under the influence of the spring 33 toward the continuously rotating character band 20. As seen in FIG. 8, since the paper 16 and the ribbon 208 are positioned between the hammer face 34 and the character slug 118 in the well-known backprinting mode, the character is caused to be printed on the paper when the hammer strikes the character slug. After printing, the hammer returns to its cocked position with the flag face in contact with the pole face. In order to vary the firing time of the hammer, the knob 204 is rotated to selectively adjust the delay before the hammer is fired. It has been found that the optimum delay may be best determined by visually observing the print quality of the characters imprinted on the paper 16.

In the preferred embodiment, a character column pitch C has a width of 0.1 inches, H is 0.285 inches, HP is 0.3 inches, and CP is 0.35 inches. The hammer recycle time is 1.2 milliseconds. Accordingly, the type velocity is approximately 83 inches per second. The maximum time required to print a line is equal to the sum of the time required to scan the 64 character set and the time required to move the paper up one line. From the above it can be determined that when a set of 64 characters is arranged sequentially around the belt 20, the time required to scan the 64 character set is equal to about 268 milliseconds, and the time required to move the paper up one space is about 25 milliseconds. Consequently, the time required to print a line is equal to 293 milliseconds per line which can be translated into a printing rate of about 205 lines per minute.

It should be realized that the print speed can be increased by decreasing the character pitch to just above 0.3 inches. However, in decreasing the character pitch, care should be taken to prevent ghosting from occurring.

In an alternate embodiment, the same overall minimum throughput is achieved by doubling the type velocity, although two scans are required to complete the scan of a character line. This embodiment is advantageous when very short lines are to be printed since the lines may be printed up to twice as fast as in the preferred embodiment. Other embodiments may encompass hammers having widths adapted for use with different multiples of the character column pitch.

From the above, it will be seen that there has been provided a line printer which fulfills all of the objects and advantages set forth above.

While there has been described what is at present considered to be the preferred embodiment of the invention, it will be understood that various modifications may be made therein, and it is intended that the appended claims cover all such modifications as fall within the true spirit and scope of the invention.

What is claimed is:

1. A line printer for printing lines of print characters on a continuous paper form comprising:

a band gate having a registration surface and having a latch pin;

a recirculating character belt rotatably carried by said band gate, said belt having a plurality of character slugs affixed thereto;

a frame including a hammer bank having a plurality of hammers, each of said hammers having a face and being movable between a cocked position and striking position, each said face being positioned to strike one of said character slugs when said hammer is in said striking position, means for pivotally mounting said band gate to said frame so that said band gate may be rotated between a printing position and a paper form loading position, and latching means affixed to said frame and including a latch plate for engaging said latch pin to hold said band gate in said printing position and means for allowing incremental adjustment of said latch plate to vary the disposition of said band gate relative to said frame when said band gate is in said printing position so that when said hammers are in said cocked position the distance between the faces thereof and the corresponding character slugs may be selectively adjusted to accommodate papers of different thicknesses; and means for moving said hammers back and forth between said cocked and striking positions.

2. A line printer for printing lines of print characters on a continuous paper form as recited in claim 1 wherein said latch plate is rotatable and has a notch provided therein for receiving said latch pin.

3. A line printer for printing lines of print characters on a continuous paper form as recited in claim 2 wherein said latching means further includes a handle rotatably coupled to said latch plate and having a first detent protruding therefrom, a detent block affixed to said frame and having a plurality of second detents adapted to receive said first detent, an eccentric cam affixed to said handle and adapted to bear against said frame whereby rotation of said handle causes a corresponding movement of said plate relative to said frame, thereby serving to vary the pivoting of said band gate in accordance with the engagement between said first and second detents.

4. A line printer for printing lines of print characters on a continuous paper form as recited in claim 3 wherein said latch plate includes a tongue portion, and said handle includes a pawl protruding therefrom for engaging said tongue portion when said handle is rotated past the end one of said plurality of second detents whereby when said pawl is engaged with said tongue portion said notch is disengaged from said latch pin so as to allow said band gate to pivot into said loading position.

5. A line printer for printing lines of print characters on a continuous paper form as recited in claim 4 including resilient means for urging said tongue portion toward said band gate so as to bias said latch plate toward said latch pin.

6. A line printer for printing lines of print characters on a continuous paper form as recited in claim 2 wherein said latching means includes a resilient plunger protruding from said frame that is adapted to contact and urge said registration surface away from said frame, thereby to maintain said latch pin within said notch.

7. A line printer for printing lines of print characters on a continuous paper form as recited in claim 1 and further comprising a paper feed mechanism for feeding said paper between said face and said character slugs, said mechanism comprising a first shaft, a pair of feed wheels which are disposed on said shaft for engaging and driving said paper upward upon rotation of said first shaft, a stepping motor having an output shaft that is rotatable in response to an input signal, means for coupling said output shaft to said first shaft, and means for applying an input signal to said stepping motor.

8. A line printer for printing lines of print character on a continuous paper form as recited in claim 7 wherein said means for applying an input signal comprises a pulse generator having an output terminal that is coupled to said stepping motor and a control terminal, and feedback means coupled between said output terminal and said control terminal and operative to sense the number of pulses applied to said stepping motor and to stop said pulse generation when said number of pulses reaches a preselected value.

9. A line printer for printing lines of print characters on a continuous paper form as recited in claim 8 wherein said feedback means includes a first counter responsive to sense 3 pulses, a second counter responsive to sense 4 pulses, and means for selectively connecting one of said first and second counters to said control terminal.

10. A line printer for printing lines of print characters on a continuous paper form as recited in claim 1 wherein said band gate includes first and second pulleys for removably carrying said belt therearound, said first pulley being movable from a normal position to a relaxed position wherein the distance between pulley centers is decreased, and means for moving said first pulley from said normal position to said relaxed position, thus facilitating removal of said belt.

11. A line printer for printing lines of print characters on a continuous paper form as recited in claim 10 wherein said means for moving said first pulley includes a yoke that is pivotally secured to said band gate for carrying said first pulley, means for biasing said yoke in said normal position, and handle means for cammingly engaging said gate to move said first pulley between said normal and said relaxed positions.

12. A line printer for printing lines of print characters on a continuous paper form as recited in claim 11 and further comprising a skew adjustment arm having one end that is pivotally secured to said yoke, said skew adjustment arm being angularly movable relative to said yoke, second means for biasing said skew adjustment arm away from said yoke, and means for adjusting the angular position of said skew adjusting arm relative to said yoke.

13. A line printer for printing lines of print characters on a continuous paper form as recited in claim 1 wherein each said face spans three print characters and wherein each said character has a predetermined width, said slugs being positioned on said belt such that the separation between adjacent slugs is greater than the span of each said face, the recycle period of each said hammer being substantially less than the time required for said character to move between adjacent print positions, whereby a single hammer face is able to strike a single selected character in three successive print positions.

* * * * *